US006070869A

United States Patent [19]

Kim

[11] Patent Number: 6,070,869

[45] Date of Patent: Jun. 6, 2000

[54] PAPER REVERSING APPARATUS OF A PRINTER FOR PRINTING BOTH SIDES OF A PAPER

[75] Inventor: Yong-su Kim, Yongin, Rep. of Korea

[73] Assignee: Samsung Electronics Co., Ltd., Kyungki-Do, Rep. of Korea

[21] Appl. No.: 09/039,578

[22] Filed: Mar. 16, 1998

[30] Foreign Application Priority Data

Aug. 14, 1997 [KR] Rep. of Korea ..... 97-38921

[51] Int. Cl.[7] ..... B65H 29/00

[52] U.S. Cl. ..... 271/186; 271/65; 271/185; 271/391; 271/301

[58] Field of Search ..... 271/65, 185, 186, 271/291, 301

[56] References Cited

U.S. PATENT DOCUMENTS

| | | | |
|---|---|---|---|
| 5,089,857 | 2/1992 | Xydias | 271/186 |
| 5,415,391 | 5/1995 | Wong et al. | 271/186 |
| 5,438,435 | 8/1995 | Lawniczak | 271/186 |
| 5,791,645 | 8/1998 | Takada | 271/186 |

FOREIGN PATENT DOCUMENTS

| | | | |
|---|---|---|---|
| 2-277671 | 11/1990 | Japan | B41J 13/00 |

OTHER PUBLICATIONS

Patent Abstracts of Japan, vol. 015, No. 047 (P–1162), Feb. 5, 1991 & JP 02 280172 A (Ricoh Co., Ltd.) Nov. 16, 1990 *Abstract.

Patent Abstracts of Japan, vol. 018, No. 592 (M–1702) Nov. 11, 1994 & JP 06 219651 A (Ricoh Co., Ltd.) Sep. 9, 1994 *Abstract.

Patent Abstracts of Japan, vol. 010, No. 040 (M–454) Feb. 18, 1986 & JP 60 191943 A (Ricoh KK) Sep. 30, 1985 *Abstract.

*Primary Examiner*—Christopher P. Ellis
*Assistant Examiner*—Richard Ridley
*Attorney, Agent, or Firm*—Sughrue, Mion, Zinn, Macpeak & Seas

[57] ABSTRACT

An apparatus is provided for reversing a paper in a printer so as to allow printing of both sides of the paper by a printing unit. A resupplying member feeds unprinted paper to a paper feeding guide coupled to a printing unit and reversing guide. The reversing guide reverses the printed paper and outputs the paper. The resupplying member resupplies the paper having one side printed thereon into the paper feeding guide for printing of the opposite side of the paper.

1 Claim, 4 Drawing Sheets

PAPER REVERSING APPARATUS OF A PRINTER FOR PRINTING BOTH SIDES OF A PAPER

BACKGROUND OF THE INVENTION

1. Field of the Invention

The present invention relates to an apparatus for reversing a sheet of paper and supplying the reversed paper to a printing unit to print both sides of the paper.

2. Description of the Related Art

In a typical printer or a copying machine for double-sided printing, an apparatus for reversing a sheet of paper and supplying the reversed paper to a printing unit in sequence is provided in order to print an image on both sides of the supplied paper.

As shown in FIG. 1, a conventional paper reversing apparatus includes forward-directional transfer rollers 40 which transfer a paper supplied from a paper cassette 20 or a manual feed tray 30 toward an output roller 60 via a printing unit 10, and reverse-directional transfer rollers 50 transferring the paper of the output roller 60 in the reverse direction, reversing the transferred paper, and again supplying the reversed paper to the printing unit 10.

In a printing process, a sheet of paper is supplied from the paper cassette 20 or the manual feed tray 30 and passed through the printing unit 10 for printing an image on one side of the paper. After one side of the paper is completely printed, the paper is caught by the output roller 60. The output roller 60 reversely rotates to resupply the paper, having one side already printed, by the reverse-directional transfer roller 50 to the printing unit 10 along a route indicated by the dotted lines in FIG. 1. At this time, the paper proceeds in the reverse direction to enter the printing unit 10 while the upper and lower side surfaces are reversed. As a result, an image can be printed on the other side of the paper. After both sides of the paper are completely printed, the paper is transferred by the forward-directional transfer roller 40 and is output by the output roller 60 to an output tray 70.

However, the conventional apparatus suffers from the disadvantage that the printer must be large in order to accommodate the conventional paper reversing apparatus since the paper must be transferred forwardly and reversely along a long route inside the printer.

SUMMARY OF THE INVENTION

To solve the above problem, it is an objective of the present invention to provide an apparatus for reversing a sheet of paper in a printer for printing both sides of the paper having an improved structure in which the route for reversing the paper is shortened.

Accordingly, to achieve the above objective, there is provided an apparatus for reversing a paper in a printer for printing both sides of the paper which includes a paper feeding guide coupled to an inlet of a printing unit, for guiding an unprinted sheet of paper or a paper having one side printed to the printing unit. In addition, a paper output guide is coupled to an outlet of the printing unit, for outputting a paper having both sides thereof printed out of a main body of the printer, and a reversing guide branching from the paper output guide, for allowing reversing of the side of the paper having one side printed which is output from the printing unit and resupplying the reversed paper toward the inlet of the printing unit. The apparatus also includes a means for selectively guiding the leading edge of the paper having one side printed through the printing unit to proceed toward either the paper output guide or the reversing guide, and a means for resupplying a paper having one side printed which is supplied from the reversing guide to the paper feeding guide and supplying the unprinted sheet of paper to the paper feeding guide.

It is preferable in the present invention that the paper resupplying means includes a shaft being rotated by a driving source forwardly or reversely, having a first gear provided at one end thereof, a second gear coupled to one of the pickup rollers, a pair of brackets pivotally installed to support the pickup rollers and the shaft, an idle gear rotatably coupled to the bracket between the first and second gears to transfer a rotational force to the first and second gears, a friction member fixed to the bracket and friction-coupled to the idle gear, and stoppers for limiting the pivotal range of the bracket. As the first gear of the shaft rotates forwardly or reversely, the bracket pivots due to a frictional force between the idle gear and the friction member to thereby be selectively aligned with either the outlet of the reversing guide or the inlet of the paper feeding guide, and when the bracket is stopped by the stopper, the idle gear rotates by the rotational force greater than the frictional force so that the rotational force is transferred to the second gear.

Also, it is preferable in the present invention that the guiding means includes a pivot plate pivotally installed at the point where the paper output guide and the reversing guide branch away from each other for selectively blocking the passage of the paper output guide, and an actuator for pivoting the pivot plate.

BRIEF DESCRIPTION OF THE DRAWINGS

The above objective and advantages of the present invention will become more apparent by describing in detail a preferred embodiment thereof with reference to the attached drawings in which:

FIGS. 3*a* through 3*c* are views for explaining the operation of the paper reversing apparatus shown in FIG. 2, in which FIG. 3*a* shows a sheet of a paper being supplied to a printing unit; FIG. 3*b* shows the paper having one side printed returning to an inlet of the printing unit by a reversing guide; and FIG. 3*c* shows the paper having one side printed being resupplied to the printing unit.

DETAILED DESCRIPTION OF THE INVENTION

Figure 2:
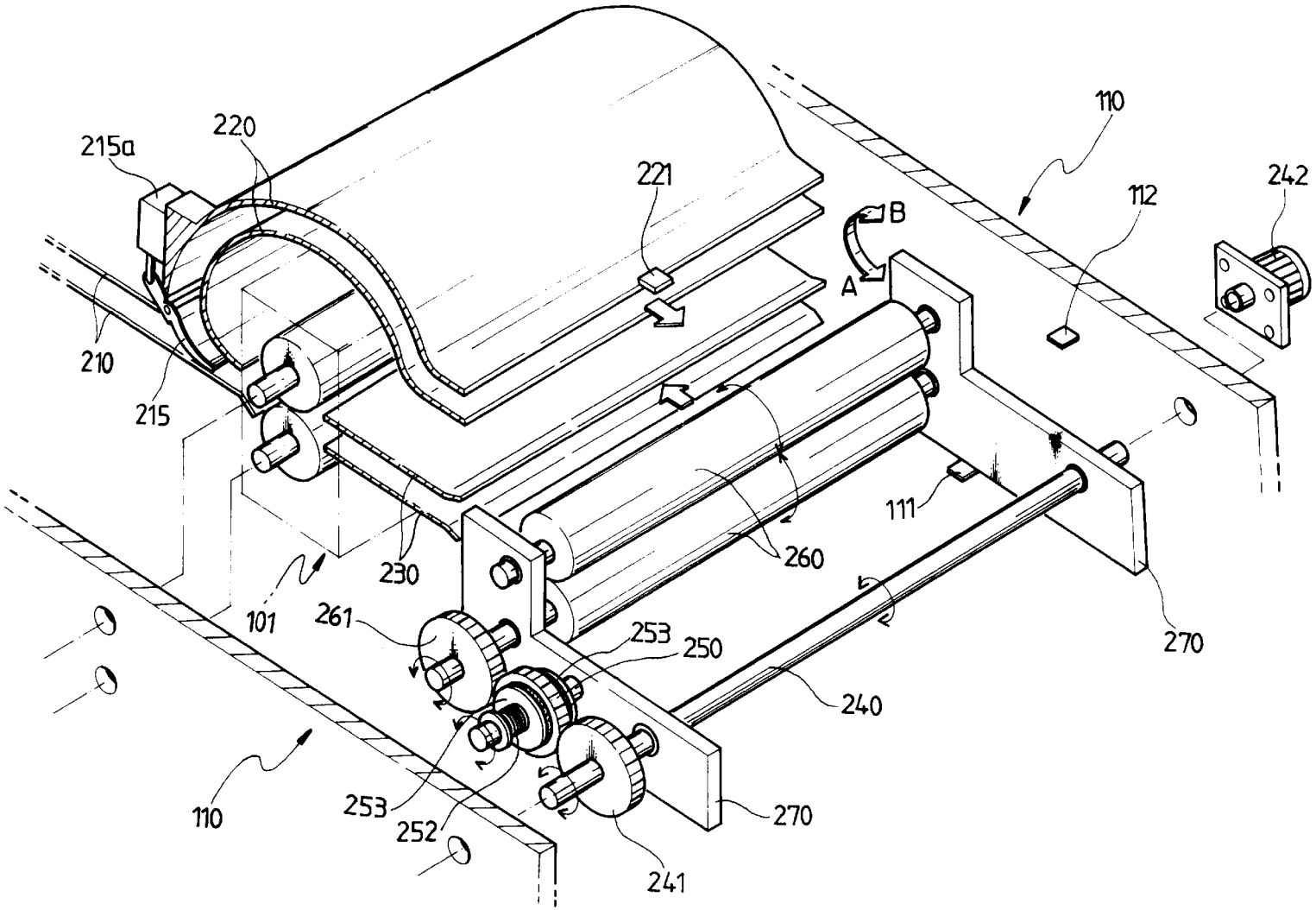
FIG. 2 is a perspective view illustrating an apparatus for reversing a sheet of a paper according to the present invention.

As shown in FIG. 2, a printing unit 101 is installed inside a main body of a printer (not shown), and a paper feeding guide or paper supply guide 230 and a paper output guide 210 are installed at an inlet and an outlet of the printing unit 101, respectively. The paper supply guide 230 guides the entry of paper to the printing unit 101 and the paper output guide 210 guides the printed paper from the printer.

Also, a reversing guide 220 for reversing the paper passing through the printing unit 101 and supplying the same to the inlet of the printing unit 101 is formed adjacent to and branching away from the entrance of the paper output guide 210. A means for selectively guiding the paper having passed through the printing unit 101 to proceed along the paper output guide 210 or the reversing guide 220 is installed at a point where the paper output guide 210 and the reversing guide 220 branch away from each other.

The guiding means comprises a pivot plate 215 and an actuator. The pivot plate 215 is pivotally installed at the branching point of the paper output guide 210 and the reversing guide 220 and selectively guides the leading edge of the paper having passed through the printing unit 101 to proceed toward either the paper output guide 210 or the reversing guide 220, and the actuator, such as a solenoid 215*a*, actuates the pivot plate 215.

Figure 1:
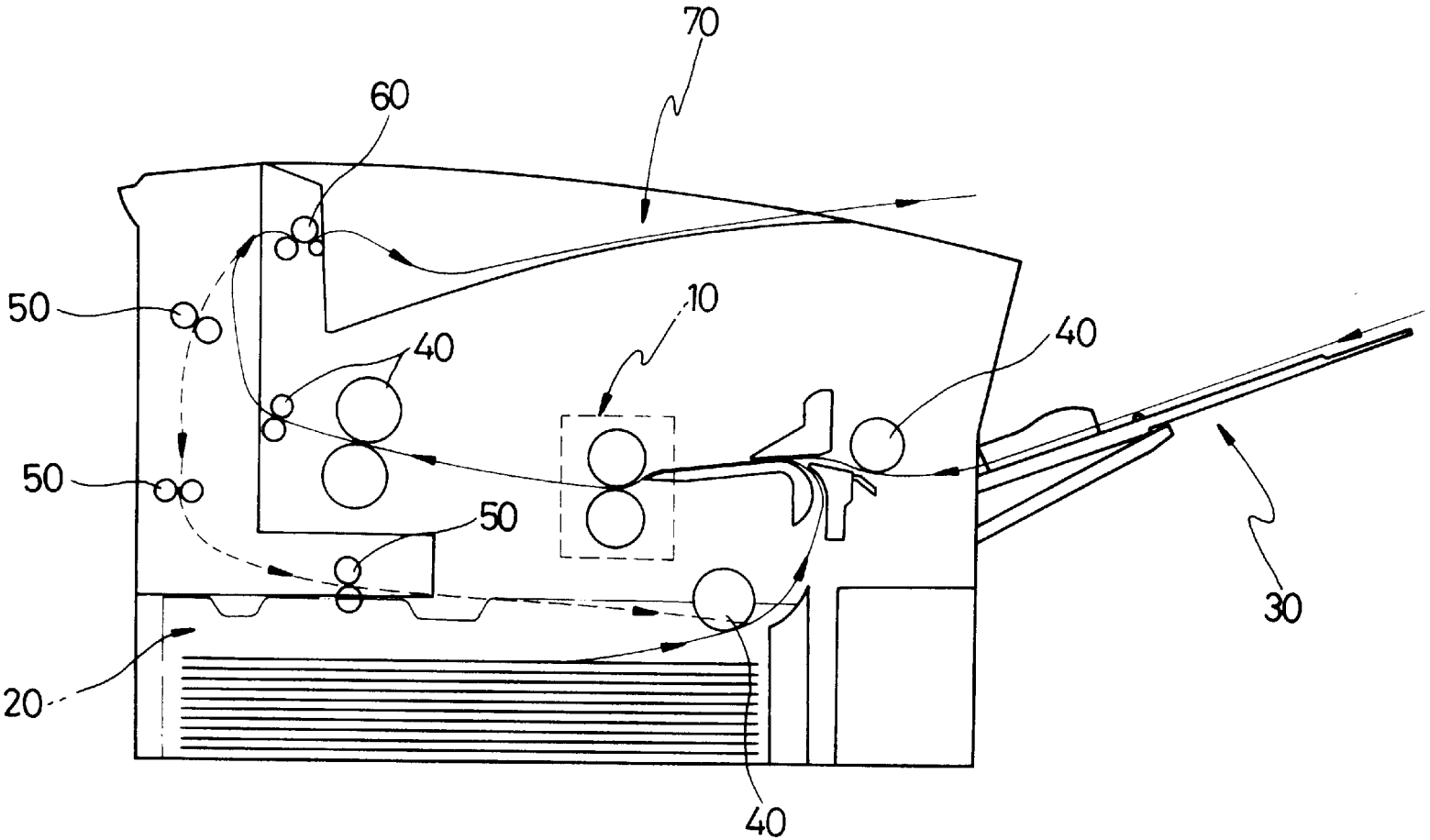
FIG. 1(PRIOR ART)
FIG. 1 is a sectional view schematically showing a route for a paper in a printer adopting a conventional paper reversing apparatus.

The paper reversing apparatus of the present invention comprises a paper resupplying means for supplying a paper from the paper cassette 20 or the manual feed tray 30 (see FIG. 1) to the paper supply guide 230 and resupplying the paper supplied through the reversing guide 220 to the paper supply guide 230.

The paper resupplying means comprises a pair of pickup rollers 260 which are installed at an inlet of the printing unit 101 for supplying the paper to the paper supply guide 230. The pickup rollers 260 are rotatably driven by a motor 242 in a forward or the reverse direction. The motor 242 is coupled with a shaft 240 having a first gear 241 formed at one end thereof. A second gear 261 is provided at one end of the shaft of one of the pickup rollers 260. Thus, the rotational force of the motor 242 is transferred to the pickup rollers 260 via the first gear 241, an idle gear 250 and the second gear 261. The shaft 240 and the pickup rollers 260 are rotatably supported by a pair of brackets 270.

The idle gear 250 transfers the rotational force of the first gear 241 to the second gear 261 and rotates in contact with a friction member 253 which is coupled to one side of the bracket 270. The idle gear 250 is pressed against the friction member 253 by a spring 252. The frictional contact between the idle gear 250 and the friction member 253 is intended to selectively pivot the paper resupplying means toward either the reversing guide 220 or the paper output guide 230, as will be described later. Reference numeral 110 denotes a partition wall inside the printer main body; reference numerals 111 and 112 respectively denote first and second stoppers to limit the pivotal range of the bracket 270 such that the pickup rollers 260 can be aligned with the paper supply guide 230 or the reversing guide 220; and reference numeral 221 denotes a sensor for detecting whether paper is being passed through the guide.

The operation of the paper reversing apparatus having the above structure according to the present invention will now be described.

Figure 3A:
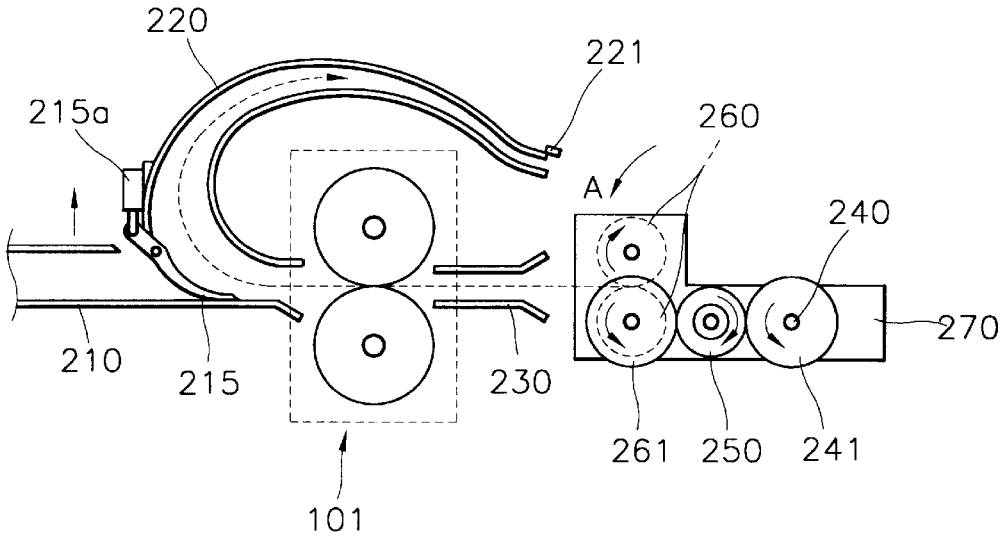

When a sheet of a paper to be printed is supplied, as shown in FIG. 3A, the shaft 240 is rotated by the motor 242 (see FIG. 2) counterclockwise. Accordingly, the idle gear 250 interlocked with the first gear 241 receives a rotational force. Since the idle gear 250 contacts the friction member 253, the idle gear 250 does not rotate on its axis but revolves counterclockwise around the first gear 241 along the outer circumference of the first gear 241. Accordingly, the bracket 270 itself rotates around the shaft 240 as indicated by arrow "A". The brackets 270 further rotate until stopped by the first stopper 111 (see FIG. 2).

When the brackets 270 are stopped by the first stopper 111, the pickup rollers 260 are aligned with the paper supply guide 230 so that a paper (not shown) can be supplied to the paper supply guide 230. Concurrently, the idle gear 250 begins to rotate by receiving a rotational force from the first gear 241 which is greater than the frictional force between the idle gear 250 and the friction member 253. Thus, the rotational force of the first gear 241 is transferred to the pickup rollers 260 via the idle gear 250 and the second gear 261 so that the pickup rollers 260 rotate. Therefore, the paper supplied from the paper cassette 20 or the manual feed tray 30 (see FIG. 1) passes between the pickup rollers 260 and through the paper supply guide 230, and an image is printed on one side of the paper by the printing unit 101.

The pivot plate 215 blocks the paper output guide 210 by being driven by the solenoid 215*a* as shown in FIG. 3*a*. Accordingly, the paper having one side printed in the printing unit 101 is guided toward the reversing guide 220 by the pivot plate 215 in a path as indicated by the dotted arrow in FIG. 3*a*.

Figure 3B:
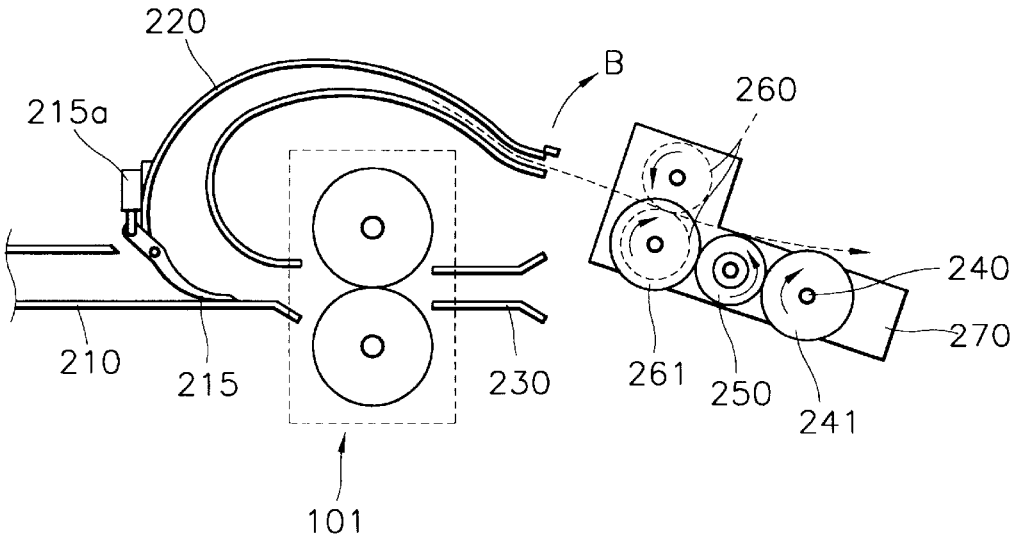

When the tailing end of the paper completely passes through the pickup rollers 260, the shaft 260 is rotated in the reverse direction, i.e., clockwise, as shown in FIG. 3*b*. Accordingly, the rotational force is transferred to the idle gear 250 interlocked with the first gear 241. At this time, the idle gear 250 does not rotate on its axis but revolves clockwise around the first gear 241 along the outer circumference of the first gear 241 due to the friction between the idle gear 250 and the friction member 253. Thus, the brackets 270 rotate around the shaft 240 as indicated by an arrow "B" until stopped by the second stopper 112 (see FIG. 2).

When the brackets 270 stop by contacting the second stopper 112, the pickup roller 260 is aligned with the reversing guide 220 so that the pickup roller 260 can be can be supplied with the paper from the reversing guide 220. Concurrently, the idle gear 250 begins to rotate by a rotational force from the first gear 241 which is greater than the frictional force between the idle gear 250 and the friction member 253. Thus, the rotational force of the first gear 241 is transferred to the pickup rollers 260 via the idle gear 250 and the second gear 261 so that the pickup rollers 260 rotate. As the pickup rollers 260 rotate, the paper having been passed through the reversing guide 220 passes between the pickup rollers 260 as indicated by dotted arrow shown in FIG. 3*b*. The sheet of paper is reversed as it passing through the reversing guide 220. Thus, the bottom side of the paper which has been printed in the printing unit 101 is changed to be the top side of the paper after passing through the reversing guide 220. In other words, the paper is flipped over after passing through the reversing guide 220.

The paper output from the reversing guide 220 is detected by the sensor 221 installed at an outlet of the reversing guide 220. Alternatively, the output of the paper can be recognized by counting the number of rotations of a motor (not shown) which drives the printing unit 101.

Figure 3C:
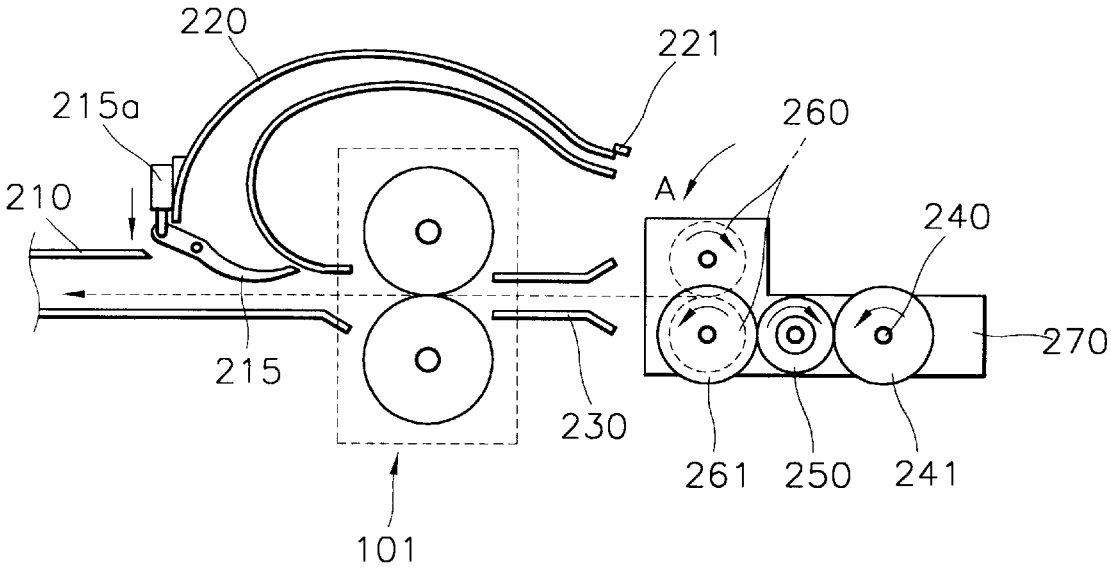

Then, when the paper is detected by the sensor 221 to be completely output, the shaft 240 is rotated counterclockwise as shown in FIG. 3*c*. As previously described, the brackets 270 pivot in a direction indicated by the arrow "A" so that the pickup rollers 260 and the paper feeding guide 230 are aligned with each other. The pickup rollers 260 resupply the paper to the paper feeding guide 230. Thus, the paper having the positions of the front and rear sides being changed is supplied to the printing unit 101, thereby enabling printing on the other side of the paper.

The pivot plate 215 opens the passage of the paper output guide 210 by being rotated by a driving force of the solenoid 215a. Then, the paper whose both sides are completely printed in the printing unit 101 is output from the printer main body through the paper output guide 210.

Therefore, in the apparatus for reversing the side of a paper of the present invention, by switching the rotational direction of the pickup rollers 260 between the forward and reverse directions while pivotally moving the pickup rollers 260 to be aligned with the paper output guide 220 and the paper feeding guide 230, the paper passed through the printing unit 101 can be resupplied by being reversed along a shortened route.

As described above, according to the apparatus for reversing a paper of a printer for printing both sides of the paper, the route for reversing the side of the paper in the printer can be shortened so that the size of the printer can be reduced.

The above description of the preferred embodiment has been given by way of example. From the disclosure given, those skilled in the art will not only understand the present invention and its attendant advantages, but will also find apparent various changes and modifications to the structures disclosed. It is sought, therefore, to cover all such changes and modifications as fall within the spirit and scope of the invention, as defined by the appended claims, and equivalents thereof.

What is claimed is:

1. An apparatus for printing both sides of a paper by reversing a paper in a printer comprising:

a paper feeding guide coupled to an inlet of a printing unit, for guiding an unprinted paper or a paper having one side printed to said printing unit;

a paper output guide coupled to an outlet of said printing unit, for outputting a paper having both sides printed out of a main body of said printer;

a reversing guide branching from said paper output guide, for reversing the paper having one side printed which has been output from said printing unit and resupplying the reversed paper having one side printed toward the inlet of said printing unit;

a means for selectively guiding a leading edge of the paper having one side printed through said printing unit to proceed toward one of said paper output guide and said reversing guide; and a means for resupplying the paper having one side printed from said reversing guide to said paper feeding guide and for supplying the unprinted paper to said paper feeding guide;

wherein said paper resupplying means comprises:

a shaft being rotated by a driving source forwardly or reversely and having a first gear provided at one end thereof;

a second gear coupled to one of said pickup rollers;

a pair of brackets pivotally installed to support said pickup rollers and said shaft;

an idle gear rotatably coupled to said bracket between said first and second gears to transfer a rotational force to said first and second gears;

a friction member fixed to said bracket and friction-coupled to said idle gear; and stoppers for limiting a pivotal range of said bracket, wherein as said first gear of said shaft rotates forwardly or reversely, said bracket pivots due to a frictional force between said idle gear and said friction member to thereby be selectively aligned with the outlet of said reversing guide and the inlet of said paper feeding guide, and when said bracket is stopped by said stopper, said idle gear rotates by a rotational force greater than the frictional force so that the rotational force is transferred to said second gear.

* * * * *